US010294785B2

(12) United States Patent
Wang et al.

(10) Patent No.: US 10,294,785 B2
(45) Date of Patent: May 21, 2019

(54) DATA EXTRACTION FOR OBM CONTAMINATION MONITORING

(71) Applicant: Schlumberger Technology Corporation, Sugar Land, TX (US)

(72) Inventors: Kang Wang, Beijing (CN); Ryan Sangjun Lee, Sugar Land, TX (US); Youxiang Zuo, Burnaby (CA); Sai Venkatakrishnan, Beijing (CN); XiaoWei Sheng, Beijing (CN); Suchart Chokthanyawat, Bangkok (TH); Lei Jiang, Beijing (CN); Lixiang Sun, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 318 days.

(21) Appl. No.: 14/975,700

(22) Filed: Dec. 18, 2015

(65) Prior Publication Data

US 2016/0186559 A1 Jun. 30, 2016

Related U.S. Application Data

(60) Provisional application No. 62/098,100, filed on Dec. 30, 2014.

(51) Int. Cl.

| | |
|---|---|
| ***E21B 49/08*** | (2006.01) |
| ***E21B 49/10*** | (2006.01) |
| ***E21B 49/00*** | (2006.01) |

(52) U.S. Cl.

CPC ..... *E21B 49/10* (2013.01); *E21B 2049/085* (2013.01)

(58) Field of Classification Search

CPC ..... E21B 49/10; E21B 2049/085

(Continued)

(56) References Cited

U.S. PATENT DOCUMENTS 6,343,507 B1 * 2/2002 Felling ..... E21B 49/10 166/254.2
6,714,872 B2 * 3/2004 DiFoggio ..... G01N 33/2823 702/12

(Continued)

OTHER PUBLICATIONS

Zuliani, M., "RANSAC for Dummies: With Examples Using the RANSAC Toolbox for Matlab and More . . . ", 2012, 101 pages.

(Continued)

*Primary Examiner* — Sheikh Maruf
(74) *Attorney, Agent, or Firm* — Michael Dae

(57) ABSTRACT

Disclosed are methods and apparatus obtaining in-situ, real-time data associated with a sample stream obtained by a downhole sampling apparatus disposed in a borehole that extends into a subterranean formation. The obtained data includes multiple fluid properties of the sample stream. The sample stream includes native formation fluid from the subterranean formation and filtrate contamination resulting from formation of the borehole in the subterranean formation. The obtained data is filtered to remove outliers. The filtered data is fit to each of a plurality of models each characterizing a corresponding one of the fluid properties as a function of a pumpout volume or time of the sample stream. Based on the fitted data, a start of a developed flow regime of the native formation fluid within the subterranean formation surrounding the borehole is identified.

20 Claims, 9 Drawing Sheets

(58) Field of Classification Search
USPC ..... 70/6; 702/6
See application file for complete search history.

(56) References Cited

U.S. PATENT DOCUMENTS

| | | | | |
|---|---|---|---|---|
| 6,799,117 | B1 * | 9/2004 | Proett | E21B 49/08 702/12 |
| 6,956,204 | B2 * | 10/2005 | Dong | E21B 47/10 250/256 |
| 7,216,533 | B2 * | 5/2007 | McGregor | E21B 33/1216 73/152.27 |
| 9,557,312 | B2 | 1/2017 | Zuo et al. | |
| 9,606,260 | B2 | 3/2017 | Zuo et al. | |
| 9,784,101 | B2 | 10/2017 | Jackson et al. | |
| 2002/0116128 | A1 * | 8/2002 | Sinha | G01V 1/48 702/6 |
| 2003/0229448 | A1 * | 12/2003 | Storm, Jr. | G01N 9/36 702/6 |
| 2004/0104341 | A1 * | 6/2004 | Betancourt | E21B 47/10 250/255 |
| 2005/0182566 | A1 * | 8/2005 | DiFoggio | E21B 47/10 702/11 |
| 2005/0216196 | A1 * | 9/2005 | Akkurt | E21B 49/08 702/6 |
| 2006/0155472 | A1 * | 7/2006 | Venkataramanan | E21B 49/00 702/10 |
| 2006/0155474 | A1 * | 7/2006 | Venkataramanan | E21B 49/00 702/13 |
| 2006/0241866 | A1 * | 10/2006 | DiFoggio | E21B 47/102 702/12 |
| 2006/0250130 | A1 * | 11/2006 | Akkurt | E21B 49/08 324/303 |
| 2007/0079962 | A1 * | 4/2007 | Zazovsky | E21B 49/008 166/264 |
| 2007/0119244 | A1 * | 5/2007 | Goodwin | E21B 47/10 73/152.28 |
| 2007/0256489 | A1 * | 11/2007 | Wu | E21B 47/06 73/152.22 |
| 2008/0083273 | A1 * | 4/2008 | Sroka | E21B 49/081 73/152.55 |
| 2008/0156088 | A1 * | 7/2008 | Hsu | E21B 49/10 73/152.23 |
| 2009/0150079 | A1 * | 6/2009 | Hsu | E21B 49/10 702/11 |
| 2010/0131204 | A1 * | 5/2010 | Dvorkin | G01V 1/30 702/6 |
| 2010/0185393 | A1 * | 7/2010 | Liang | G01V 3/28 702/7 |
| 2011/0087459 | A1 * | 4/2011 | Zazovsky | E21B 49/10 702/179 |
| 2011/0284219 | A1 * | 11/2011 | Pomerantz | E21B 49/10 166/264 |
| 2013/0311099 | A1 * | 11/2013 | Eyuboglu | E21B 49/081 702/11 |
| 2014/0360257 | A1 * | 12/2014 | Indo | E21B 47/102 73/152.28 |
| 2015/0142317 | A1 | 5/2015 | Zuo et al. | |
| 2015/0211361 | A1 | 7/2015 | Gisolf et al. | |
| 2015/0308261 | A1 | 10/2015 | Zuo et al. | |
| 2015/0308264 | A1 | 10/2015 | Zuo et al. | |
| 2016/0061743 | A1 | 3/2016 | Wang et al. | |
| 2016/0130940 | A1 | 5/2016 | Hsu et al. | |
| 2016/0186559 | A1 * | 6/2016 | Wang | E21B 49/10 702/6 |
| 2016/0252651 | A1 * | 9/2016 | Ellmauthaler | G01V 1/40 356/72 |

OTHER PUBLICATIONS

Robust Statistics (Dec. 21, 2017). In Wikipedia. Retrieved Jan. 18, 2018 from https://en.wikipedia.org/wiki/Robust_statistics.

Massart, D. L. et al., "Least Median of Squares: A Robust Method for Outlier and Model Error Detection in Regression and Calibration", Analytica Chimica Acta, 1986, 187, pp. 171-179.

* cited by examiner

DATA EXTRACTION FOR OBM CONTAMINATION MONITORING

CROSS-REFERENCE TO RELATED APPLICATIONS

This application claims priority to and the benefit of U.S. Provisional Application No. 62/098,100, titled "Data Extraction for OBM Contamination Monitoring," filed Dec. 30, 2014, the entire disclosure of which is hereby incorporated herein by reference.

BACKGROUND OF THE DISCLOSURE

Downhole fluid analysis (DFA) often involves oil-based mud (OBM) filtrate contamination monitoring (OCM). During OCM, high miscible and immiscible contamination results in unusable samples, preventing estimation of various properties of native, uncontaminated oil, such as optical density at various wavelengths, mass density, gas-oil ratio (GOR), composition, viscosity, conductivity/resistivity, and/or others.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method that includes obtaining in-situ, real-time data associated with a sample stream obtained by a downhole sampling apparatus disposed in a borehole that extends into a subterranean formation. The obtained data includes multiple fluid properties of the sample stream. The sample stream includes native formation fluid from the subterranean formation and filtrate contamination resulting from formation of the borehole in the subterranean formation. The method also includes filtering the obtained data to remove outliers from the obtained data, fitting the filtered data to models that each characterize a corresponding one of the fluid properties as a function of a pumpout volume or time, and identifying, based on the fitted data, a start of a developed flow regime of the native formation fluid within the subterranean formation surrounding the borehole.

The present disclosure also introduces a method that includes obtaining in-situ, real-time data associated with a sample stream obtained by a downhole sampling apparatus disposed in a borehole that extends into a subterranean formation. The downhole sampling apparatus is operable to obtain apparent optical density (OD), apparent mass density (ρ), and apparent gas-oil ratio (GOR) of the sample stream such that the obtained data includes OD data, ρ data, and GOR data. The sample stream includes native formation fluid from the subterranean formation and filtrate contamination resulting from formation of the borehole in the subterranean formation. The method also includes filtering the obtained data to remove outliers from the OD data, the ρ data, and the GOR data, and fitting the filtered OD, ρ, and GOR data to corresponding models that each characterize a corresponding one of OD, ρ, and GOR as a function of a pumpout volume (V) or time (t). Fitting the filtered OD, ρ, and GOR data to the corresponding models includes determining an adjustable parameter y relating the filtered OD, ρ, and GOR data to V or t. The method also includes identifying a start of a developed flow regime of the native formation fluid within the subterranean formation surrounding the borehole by: (i) generating a flow regime identification (FRID) plot by collectively plotting, relative to V or t, the fitted OD data, the fitted ρ data, the fitted GOR data, and one of $V^{-y}$ or $t^{-y}$; and (ii) identifying from the FRID plot the minimum V or t at which the plotted OD, ρ, and GOR data each substantially coincide with the one of $V^{-y}$ or $t^{-y}$. The start of the developed flow regime is the identified minimum V or t.

The present disclosure also introduces an apparatus that includes a downhole sampling apparatus and surface equipment. The downhole sampling apparatus is operable within a borehole extending from a wellsite surface into a subterranean formation. The surface equipment is disposed at the wellsite surface and is in communication with the downhole sampling apparatus. The downhole sampling apparatus and the surface equipment are collectively operable to obtain in-situ, real-time data associated with a sample stream obtained by the downhole sampling apparatus disposed within the borehole. The obtained data includes multiple fluid properties of the sample stream. The sample stream includes native formation fluid from the subterranean formation and filtrate contamination resulting from formation of the borehole in the subterranean formation. The downhole sampling apparatus and the surface equipment are further collectively operable to filter the obtained data to remove outliers from the obtained data, fit the filtered data to models each characterizing a corresponding one of the fluid properties as a function of a pumpout volume or time, and identify, based on the fitted data, a start of a developed flow regime of the native formation fluid within the subterranean formation surrounding the borehole.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
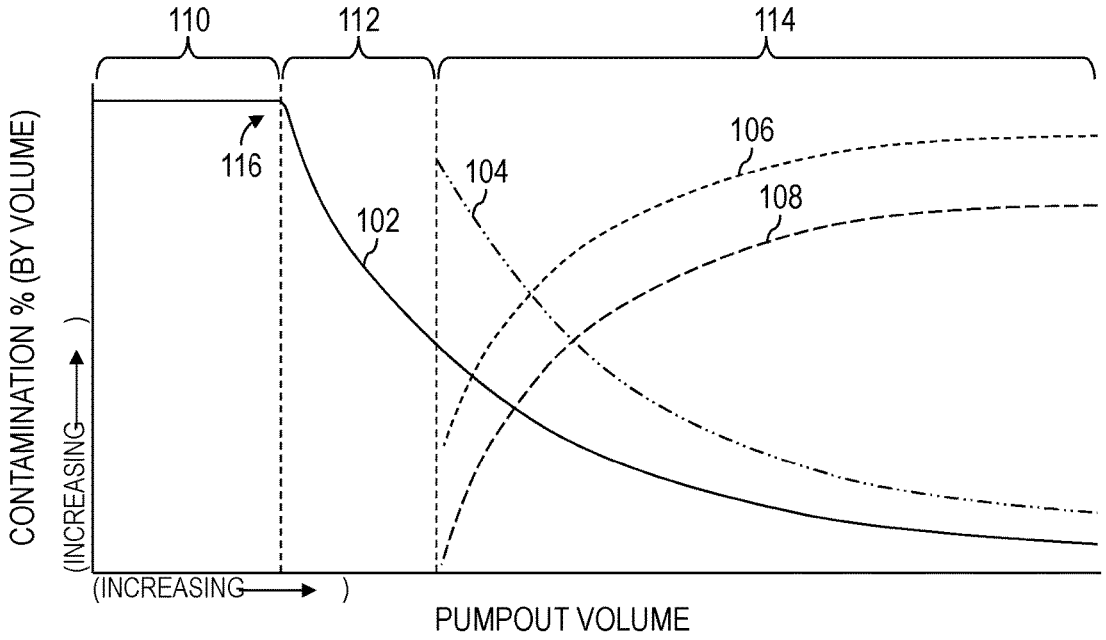
FIG. 1 is a chart pertaining to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure introduces methods pertaining to in-situ, real-time data associated with a formation fluid flowing through a downhole formation fluid sampling apparatus. The obtained data is preprocessed, and contamination monitoring is performed utilizing the preprocessed data. The preprocessing may comprise performing outlier filtering to remove outliers from the obtained data. The preprocessing may also or instead comprise performing inlier-detection-based regression. The preprocessing may also or instead comprise truncating the obtained data, based on a physical and/or time range of the data, and filtering the truncated data utilizing a median filter, a Winsorized mean filter, or a Hampel filter. The obtained or preprocessed data may be processed via regression to determine an endpoint of a property associated with the obtained fluid. The obtained or preprocessed data may also or instead be processed to identify a developed flow regime.

The cleanup process during OCM may follow linear mixing rules for many measured properties. Thus, if the information of one endpoint property is known, other properties may be extracted through linear regression. A power function behavior may be assumed for late-time cleanup, such that a linear regression (for a known exponent) or non-linear regression (for an unknown exponent) may be utilized to fit the power function model.

Such regression, however, may be hampered by an unknown percentage of outliers. That is, statistical outliers, or data not following assumed behavior, may be introduced by borehole storage, different flow regimes, flow rate changes, fluid instability, anisotropy, and/or inaccurate measurements, among other factors. Current regression methods may involve ordinary least-squares regression, which can be sensitive to outliers due to error introduced by the application of theoretical methodologies to an entire data set even with a low percentage of outliers.

The present disclosure introduces robust statistical methods to perform outlier filtering and other preprocessing of raw data. The present disclosure also introduces robust statistical methods to perform inlier-detection-based regression that may be immune to noise. The methods may be utilized separately or together. Aspects of the methods may yield cleaner data sets for subsequent processing, may aid in accurately determining endpoint properties without the influence of outliers, and/or may aid in indicating flow regimes substantially automatically.

FIG. 1 is a schematic view of a general OCM methodology according to one or more aspects of the present disclosure, depicting an OBM % contamination level curve 102, a mass density curve 104, an optical density (OD) curve 106, and a GOR curve 108. FIG. 1 also depicts a "pre-breakthrough" phase 110, a "developing flow" phase 112, and a "developed flow" phase 114. The pre-breakthrough phase 100 relates to the period during which pumpout performed by a downhole sampling apparatus substantially produces drilling fluid ("filtrate" or "filtrate contamination") adjacent the downhole sampling apparatus, with little or no native formation fluid included in the sample stream of fluid drawn into the downhole sampling apparatus. The pre-breakthrough phase 110 may vary in duration depending on the type of downhole sampling apparatus, borehole size, and pumpout rate, among other factors. The pre-breakthrough phase 110 is associated with near 100% filtrate, and therefore is easily characterized by DFA and comparison of measured values against known values of the drilling fluid utilized to form the borehole. When the region of fluid immediately surrounding the downhole sampling apparatus has been evacuated, some native formation fluid is drawn nearer the downhole sampling apparatus, and the ratio of filtrate to native formation fluid begins to decrease as more native formation fluid is drawn into the downhole sampling apparatus. This period of flow just after formation fluid breakthrough is an intermediate period that defines the developing flow regime 112.

The developing flow regime 112 correlates to a time of pumping out a high concentration of filtrate from the formation immediately surrounding the section of the borehole containing the downhole sampling apparatus. The developing flow regime 112 may physically correspond to circumferential cleanup where filtrate is drawn from around the borehole circumference at the depth of the downhole sampling apparatus before flow to the downhole sampling apparatus has been established from the region of the formation above and below the downhole sampling apparatus. The start of the developing flow regime 112 may be identified as the breakthrough of native formation fluid in the sample stream being pumped from the formation by the downhole sampling tool, such as when contamination of the sample stream exhibits a noticeable decrease, or when the rate of decreasing contamination noticeably changes, as indicated in FIG. 1 by reference number 116. The developing flow may also be identified as the start of when a linear or semi-linear relationship exists between one or more fluid properties of the sample stream and/or the pumpout volume or time, which may be determined by a cross-plot of two or more fluid properties of the sample stream, such as pumpout volume (the volume of fluid pumped from the formation), contamination level, mass density, OD, GOR, and/or other fluid properties.

As pumpout ("cleanup") continues, the sample stream becomes cleaner as contamination decreases and the volume percentage of native formation fluid increases, thus establishing developed flow of the native formation fluid. The developed flow regime 114 corresponds to a developed flow of native formation fluid through the formation surrounding the downhole sampling apparatus. Thus, the developed flow regime 114 physically corresponds to a situation where the filtrate around the circumference of the borehole at the level of the downhole sampling apparatus has been substantially removed, although some filtrate may still flow vertically from above and below the downhole sampling apparatus. The start of the developed flow regime 114 was conventionally estimated to be that point at which the contamination level fell below a predetermined threshold, such as about 15% (by volume). However, the start of the developed flow regime 114 may also be identified as when a power law is adequately descriptive of two or more of the fluid properties, such as may be determined by a flow regime identification (FRID) plot. After determining the start of the developed flow regime 114, the properties of the native formation fluid may be obtained by setting the sample stream pumpout volume (V) to infinity in the associated power law fitting, and the properties of the contamination (filtrate) may be obtained by setting GOR to zero in the associated linear (or semi-linear) relationship of GOR with respect to OD and mass density (ρ).

With regard to the linear relationships during cleanup, an assumption that there is no gas or shrinkage for the OBM results in:

- Constants/endpoints for:
  - OBM mass density ($\rho_{obm}$);
  - OBM optical density ($OD_{obm}$);
  - Mass density of the native formation fluid density ($\rho_0$));
  - Optical density of the native formation fluid ($OD_0$);
  - GOR of the native formation fluid ($GOR_0$);
  - Mass density of the native formation fluid at stock tank oil (STO) conditions ($\rho_{0STO}$);
  - Molecular weight (g/mol) of gas in the native formation fluid ($MW_g$); and
  - Shrinkage factor of the native formation fluid ($b_0$);
- Measured mass density of the contaminated fluid of the sample stream (ρ), referred to as apparent density;
- Measured optical density of the contaminated fluid of the sample stream (OD), referred to as apparent optical density;
- Gas-oil-ratio of the contaminated fluid of the sample stream (GOR), referred to as apparent GOR;
- Measured pumpout volume (V), which can be replaced by the elapsed pumpout time (t); and
- Other unknown variables, including:
  - Shrinkage factor of the contaminated fluid of the sample stream (b), which is the ratio of the formation volume factor of OBM filtrate ($B_{oobm}$, which may be about equal to one (1)) and the formation volume factor of the contaminated fluid of the sample stream ($B_o$);
  - Mass density of the native formation fluid at STO conditions ($\rho_{STO}$); and
  - OBM filtrate contamination level in volume fraction ($v_{obm}$).

When V or t approaches infinity, the OBM filtrate contamination level in volume fraction ($v_{obm}$) equals zero, indicating pure native formation fluid is being sampled. These and other variables are related as set forth below in Equations (1)-(5).

$$v_{obm} = \frac{OD_0 - OD}{OD_0 OD_{obm}} = \frac{\rho_0 - \rho}{\rho_0 - \rho_{obm}} = \frac{GOR_0 - GOR}{GOR_0 + (B_{o0} - 1)GOR} = b\frac{GOR_0 - GOR}{GOR_0} = \frac{b - b_0}{b_{obm} - b_0} = \beta V^{-\gamma} \tag{1}$$

$$\frac{1}{b} = \frac{B_o}{B_{oobm}} = \left(\frac{MW_g}{23.69\rho_0 B_{oobm}} + \frac{\rho_{0STO} - \rho_0}{\rho_0 GOR_0 B_{oobm}}\right)GOR + 1 = \frac{B_{o0} - 1}{B_{oobm} GOR_0} + 1 \tag{2}$$

$$\rho_{STO} = \frac{\rho_{0STO} - \rho_{obm}}{GOR_0} GOR + \rho_{obm} \tag{3}$$

$$B_o = \frac{\rho_{STO}}{\rho} + \frac{MW_g}{23.69}\frac{GOR}{\rho} \tag{4}$$

$$\frac{1}{b_0} = B_{o0} = \frac{\rho_{STO}}{\rho_0} + \frac{MW_g}{23.69}\frac{GOR_0}{\rho_0} \tag{5}$$

where:

- $B_{o0}$ is the formation volume factor of the native formation fluid;
- $b_{obm}$ is the shrinkage factor of the OBM filtrate, which may be about equal to one (1);
- β is an adjustable parameter;
- γ is an adjustable parameter;
- $V_{obm}$ is the volume of OBM filtrate at reservoir conditions; and
- $V_{obmStd}$ is the volume of OBM filtrate at standard conditions.

Equations (1)-(5) demonstrate that, during cleanup, a linear relationship exists for many pairs of properties, such as b being linearly related with OD, ρ, $V^{-\gamma}$, and $v_{obm}$, and $B_o$ being linearly related with GOR and $\rho_{STO}$. From these relationships, the central role of regression in OCM becomes: (1) by utilizing the linear relationship between $V^{-\gamma}$ and one of the measured or "apparent" fluid properties of the sample stream (e.g., GOR, OD, ρ, or V), extrapolating V to infinity to obtain that measured or apparent property of the native formation fluid; and (2) by utilizing the linear relationship between two fluid properties, where one of the fluid properties has a known endpoint, extrapolating to obtain both fluid properties of the OBM filtrate. However, such analyses can be problematic when utilizing raw measurement data.

Figure 2:
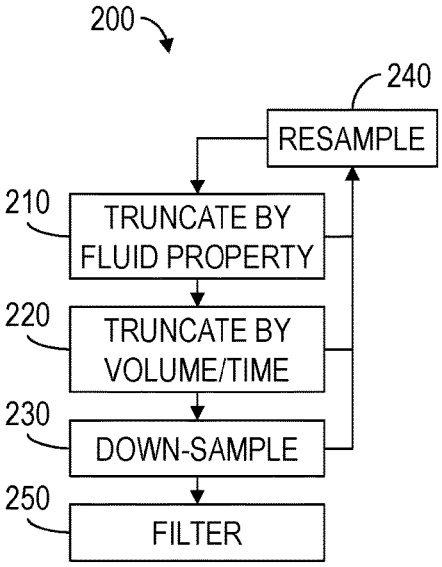
FIG. 2 is a flow-chart diagram of at least a portion of an example implementation of a method according to one or more aspects of the present disclosure.

FIG. 2 is a flow-chart diagram of at least a portion of an example implementation of a method (200) of preprocessing the raw formation fluid sampling data according to one or more aspects of the present disclosure. The method (200) may be utilized for OCM and other interpretation data preprocessing.

The method (200) may include truncating (210) the raw data based on a range of one or more of the measured, apparent, and/or other fluid properties of the raw data. For example, the raw data may be truncated (210) to those data points in which the measured optical density (OD) is between about −1.0 and about 5.0, the measured density (ρ) is less than about 1.5 grams per cubic centimeter (g/cm$^3$), and the apparent gas-oil-ratio (GOR) is less than about 1,000,000 standard cubic feet per barrel (scf/bbl). In another example implementation, the raw data may be truncated (210) to those data points in which OD is between about zero and about 3.0, ρ is between about 0.1 g/cm$^3$ and about 1.2 g/cm$^3$, and GOR is less than about 50,000 scf/bbl. In another example implementation, the raw data may be truncated (210) to those data points in which OD is between zero and about 1.5, ρ is between about 0.6 g/cm$^3$ and about 0.9 g/cm$^3$, and GOR is less than about 1,000 scf/bbl. However, other ranges may also be utilized to truncate (210) the raw data within the scope of the present disclosure, including implementations in which the truncation (210) is based on just one or two of OD, ρ, and GOR instead of each of these properties, and/or implementations in which the truncation (210) is based on additional or different fluid properties.

The raw data may also be truncated (220) based on a range of the pumpout volume (V) or pumpout time (t) of the data. For example, the data may be truncated (220) to those data points in which the pumped volume and/or time ranges between the "breakthrough" volume or time (when native formation fluid is first detected in the pumped sample stream) and the "sampling" volume or time (when the pumped sample stream is first directed into a sample chamber of the downhole tool). However, other pumpout volume and/or time ranges may also be utilized to truncate (220) the raw data within the scope of the present disclosure.

The truncation (210) based on ranges of one or more measured or apparent fluid properties and the truncation (220) based on a range of pumpout volume and/or time excludes meaningless data, and may provide a visually cleaner result. However, the truncation boundaries described above for the fluid property truncation (210) and the volume/time truncation (220) are merely examples, and such boundaries can be changed based on different situations and implementations within the scope of the present disclosure. In implementations of the method (200) that include both the truncation (210) based on one or more fluid properties and the truncation (220) based on pumpout volume and/or time, the truncations (210, 220) may be performed in either order, whether in the order depicted in FIG. 2, or in reverse of the order depicted in FIG. 2.

The method (200) may also comprise performing downsampling (230), such as by utilizing a median or Winsorized mean. For example, during OCM, the raw data frequency may be high and/or oversampled, such as in implementations in which density is measured in one Hertz (Hz) intervals, which can result in higher computational cost. The downsampling (230) may reduce the raw data by some multiple or percentage of the measurement frequency utilized to obtain the raw data. For example, raw data obtained with a measurement frequency of 1.0 Hz may be downsampled to a frequency of about 0.33 Hz, thus truncating the raw data to the first data point of each three consecutive data points, or perhaps replacing each set of three consecutive data points with the median or Winsorized mean of the three consecutive data points, among other examples within the scope of the present disclosure. However, the downsampling (230) may utilize various other known or future-developed algorithms. Although FIG. 2 depicts the downsampling (230) as being performed on the data resulting from first performing the fluid property truncation (210) and the pumpout volume/time truncation (220), the downsampling (230) may instead be performed on the raw data prior to performing either of the truncations (210, 220).

The method (200) may also comprise resampling (240) if, for example, the fluid property truncation (210), the volume/time truncation (220), and/or the downsampling (230) is excessively exclusive of meaningful data. Such resampling (240) is a relatively fast procedure, and may be performed in real-time during various stages of the method (200).

The method (200) also includes filtering (250) the results of the fluid property truncation (210), the volume/time truncation (220), and/or the downsampling (230). Such filtering (250) may utilize a median filter, a Winsorized mean filter, or a Hampel filter, among other example filtering techniques that may also or instead be utilized. A median filter and a Winsorized mean filter for raw data may be relatively simple to implement, but may be less robust, whereas a Hampel filter may be more robust but may also be time consuming. Thus, for example, in implementations in which the optional downsampling (230) is performed, the subsequent filtering (250) may utilize a Hampel filter, while in implementations in which the optional downsampling (230) is not performed, the filtering (250) may instead utilize a median filter or a Winsorized mean filter.

After performance of one of the various implementations of the method (200) described above and/or otherwise within the scope of the present disclosure, the resulting "preprocessed" data may then be utilized to determine the various fluid properties of the native formation fluid and/or the filtrate contamination, such as by utilizing one or more of Equations (1)-(5) set forth above and one or more regression techniques. Various regression techniques may be utilized within the scope of the present disclosure, including L2-least squares (LS), L1-LS, total-LS, least median of squares (LMS), RANSAC, and genetic algorithms, among other examples. An L2-LS regression may be direct and fast, but may sometimes be corrupted by outliers. An L1-LS regression may be less affected by outliers, but may sometimes have slower performance. A total-LS regression may be the most rigorous of the mentioned techniques, and may be a good option for line fitting, but may result in an eigenvalue problem.

An LMS regression may also be robust technique, particularly for OCM purposes. Such regression entails a nonlinear optimization, and is based on minimizing the median of the squared residuals determined for the entire data set. The LMS regression generally entails finding a set of parallel lines of minimum length that enclose [(n/2)+1] of the points in a data set having a number n of points. The LMS regression may have a breakdown point of at least about 50% of the points as outliers. However, determining the regression line can be a computationally intensive process, and may suffer from low precision.

RANSAC is an outlier immune algorithm in which, instead of filtering the outliers, identification of inliers is first attempted. It may be among the most robust of the mentioned techniques, but the threshold setting may be problem specific.

Experimental results demonstrate that RANSAC and LMS may be particularly suited for OCM regression due to a breakdown point of over about 50%. Since the results for RANSAC and LMS were similar, the following description refers to an example RANSAC technique, but LMS and other regression techniques may also be utilized.

Figure 3:
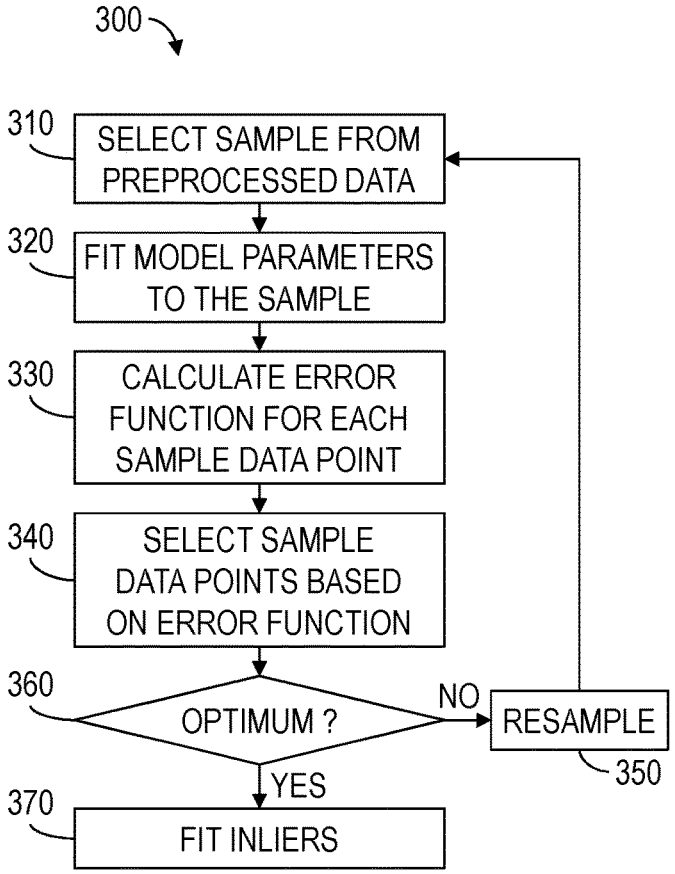
FIG. 3 is a flow-chart diagram of at least a portion of an example implementation of a method according to one or more aspects of the present disclosure.

The RANSAC technique entails just two external parameters, namely, fit start/end and threshold fraction. The threshold fraction is adjusted within a predetermined range (such as between 0.1 and 1.0, among other examples) by rescaling with a multiplier of median absolute deviation (median of the absolute of all data deviation from the median). FIG. 3 is a flow-chart diagram of an example implementation of the RANSAC regression method (300) according to one or more aspects of the present disclosure.

The method (300) includes selecting (310) a sample of the n data points, where the sample includes a number m of the n data points selected at random. The n data points may be the results from performing one or more implementations of the method (200) described above. The number m of data points may be larger than the minimum number of points necessary to determine the regression model (e.g., two points for a linear model, or three points for a power function model), and significantly smaller than the number n of total data points, such as to reduce computation time. For example, the number m may be between two and give, and the number of iterations may be about 1000. In another example implementation, the number m may be about 0.01*n, and the number of iterations may be about 100. However, these are merely examples, and other values and ranges are also within the scope of the present disclosure.

Model parameters are then fit (320) to the selected (310) sample of m data points, such as by utilizing Equations (1)-(5) set forth above. An error function is then calculated (330) for each of the m data points. The error function may be calculated (330) by one or more conventional techniques. The data that support the current hypothesis of the model are then selected (340) utilizing the calculated (330) error function. The method (300) may also include performing a resampling (350) and performing additional iterations of the sample selection (310), model fitting (320), error calculation (330), and supportive data selection (340), including adjusting the threshold fraction and/or the fit start/end with each iteration to determine (360) the optimum value for a fitting parameter (such as the exponent "$-\gamma$" described above) that results in the highest percentage of inliers. The optimized set of inliers may then be linearly fitted (370), such as by utilizing a total-LS and/or other regression technique.

Figure 4:
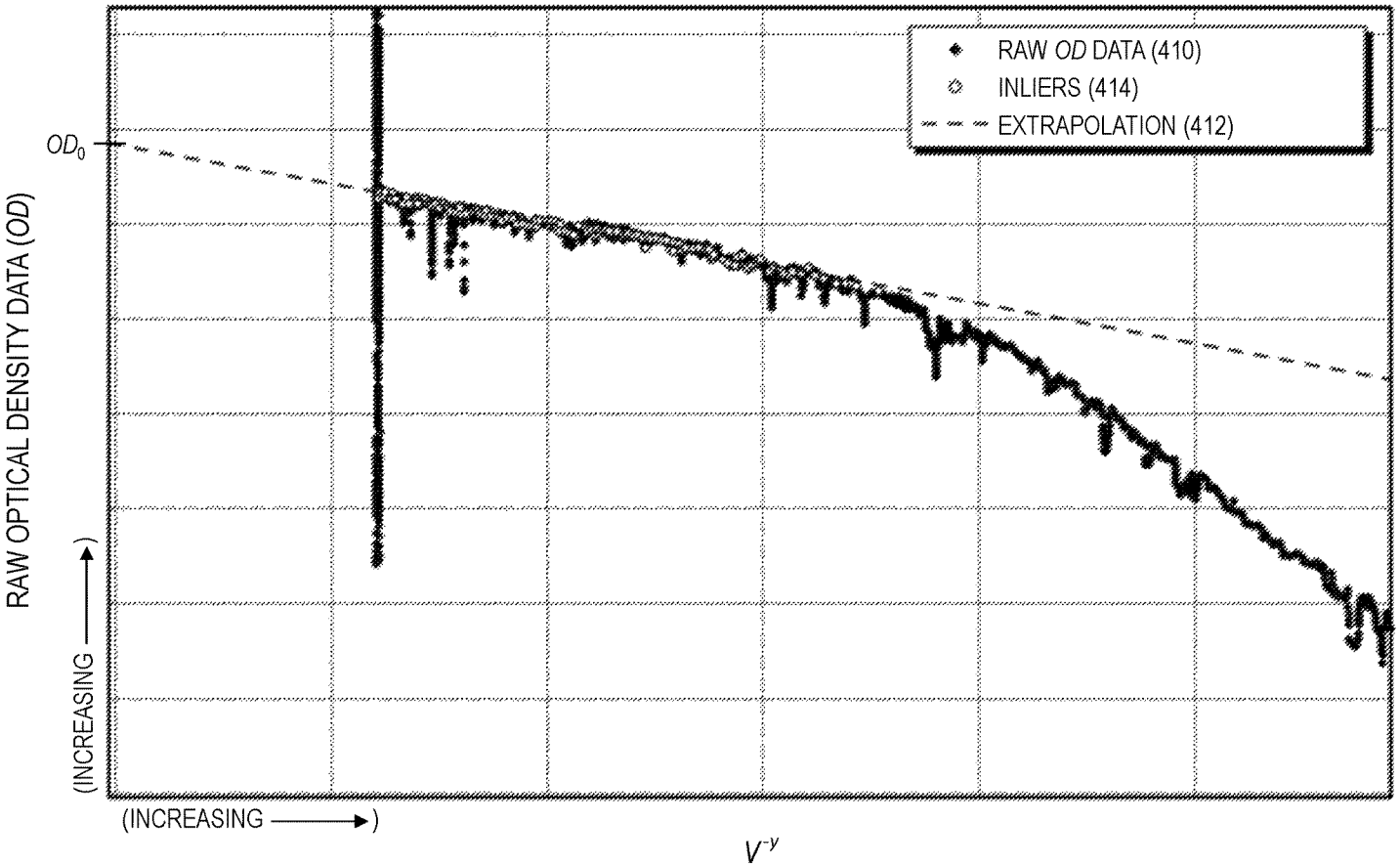
FIG. 4 is a graph depicting example data pertaining to one or more aspects of the present disclosure.
Figure 5:
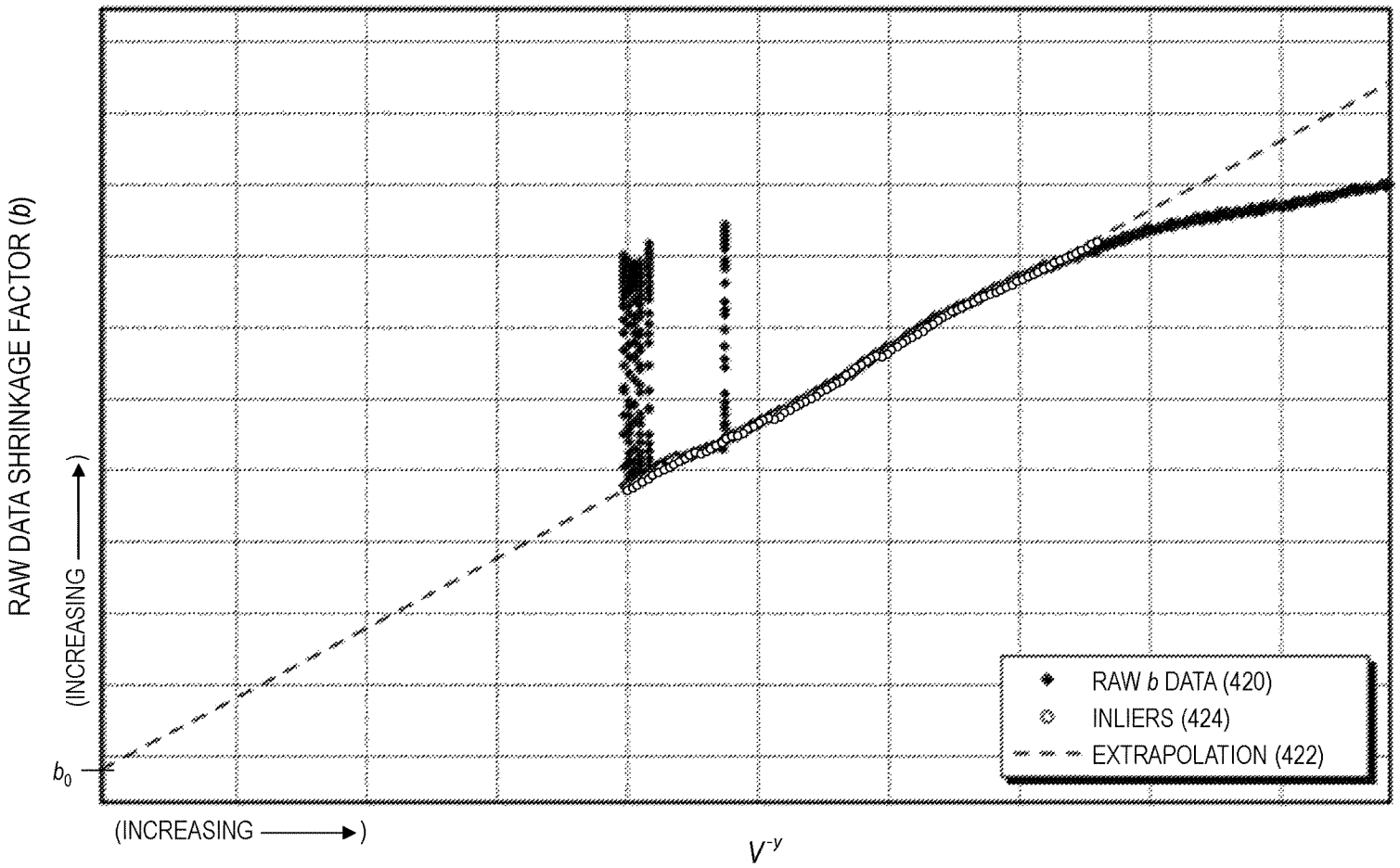
FIG. 5 is a graph depicting example data pertaining to one or more aspects of the present disclosure.

The method (300) may be performed to determine sample line linearity between $V^{-\gamma}$ and OD, ρ, and/or b, which will give the virgin oil property by extrapolating to the Y-axis. Examples of extrapolating to determine $OD_0$ and $b_0$ are given in FIGS. 4 and 5. FIG. 4 depicts raw apparent optical density (OD) data 410 versus $V^{-\gamma}$ after the exponent "$-\gamma$" has been determined utilizing the method (300), and the extrapolation 412 of the inliers or other regression results 414 to determine the optical density of the native formation fluid (OA). FIG. 5 depicts raw shrinkage factor (b) data 420 versus $V^{-\gamma}$ after the exponent "$-\gamma$" has been determined utilizing the method (300), and the extrapolation 422 of the inliers or other regression result 424 to determine the shrinkage factor of the native formation fluid ($b_0$).

The methods described above can also be used to determine dual flowline linearity between different OD channels, or between OD and density or G-function, or other pairs of properties described above with respect to Equations (1)-(5). That is, because one endpoint is known, the properties of the native formation fluid and the filtrate contamination can be determined.

The measurement property linear relationship determined as described above can also be utilized to determine the beginning of developing flow regime, and the linear relationship between $V^{-\gamma}$ and various properties determined as described above can also be utilized to determine the developed flow regime. One can also identify local ranges that do not follow the mixing behavior, such as may be caused by various measurement issues. These local data act as outliers that can also be removed.

Figure 6:
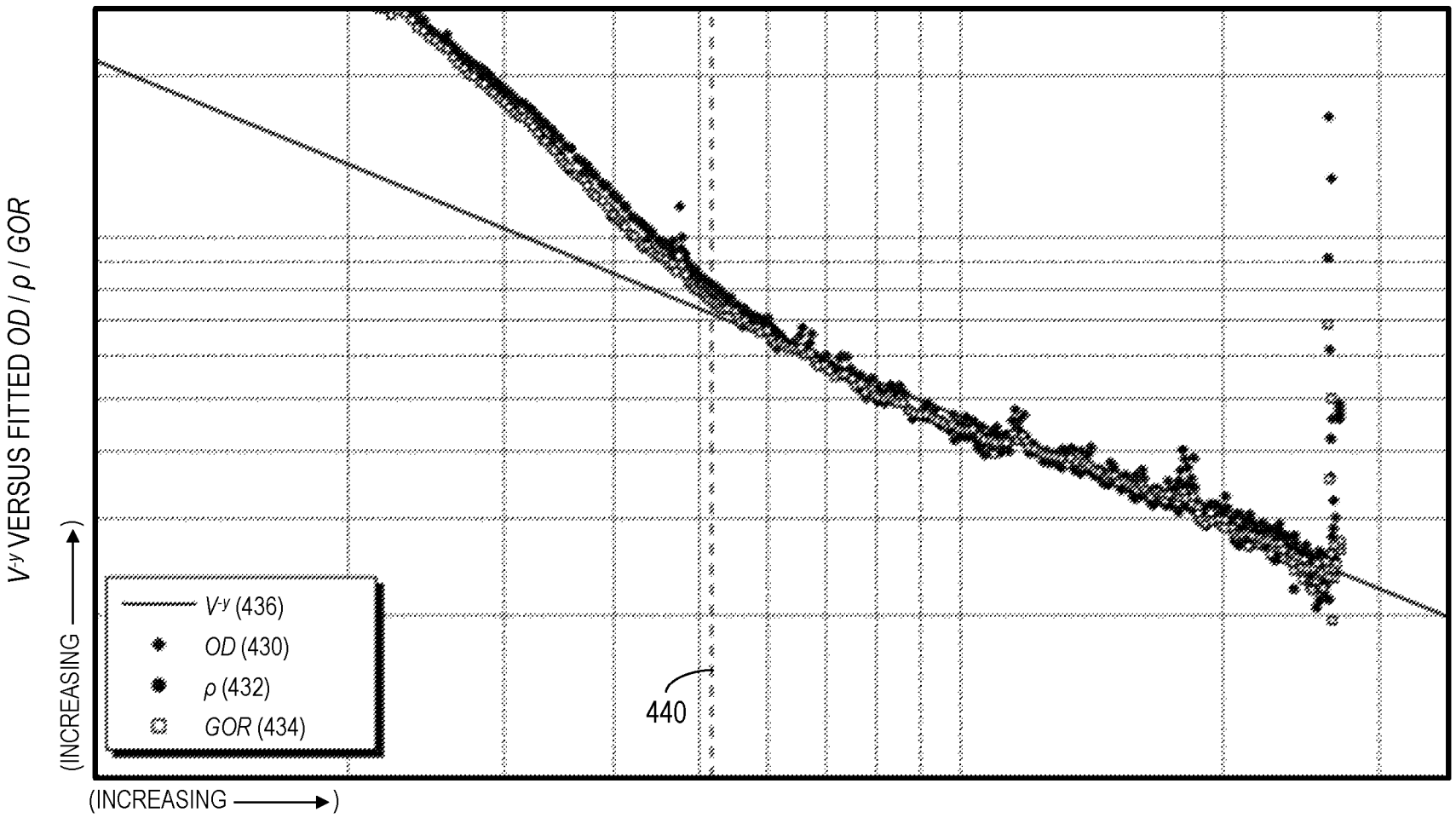
FIG. 6 is a graph depicting example data pertaining to one or more aspects of the present disclosure.

An example of identifying developed flow regime is depicted in FIG. 6. A drawback of a traditional plot for the fitting is the display scale. That is, the physical properties change linearly (semi-linearly for GOR) with the exponential of the pumpout volume/time. Thus, an FRID plot may be utilized, where pumpout volume V or time t is utilized as the X-axis, and the fluid properties values are represented on the Y-axis, which is logarithmic. The example FRID plot shown in FIG. 6 includes a fitted OD curve 430, a fitted ρ curve 432, and a fitted GOR curve 434, each obtained as described above and plotted together as a function of V. The example FRID plot shown in FIG. 6 also includes a $V^{-\gamma}$ curve 436, which is a straight line because it varies exponentially with V and the Y-axis is logarithmic.

Because the end points for OD, ρ, and GOR can be determined as described above, Equation (1) set forth above can be rewritten as set forth below in Equation (6).

$$V^{-\gamma} = \frac{\rho - \rho_0}{a_1} = \frac{OD_0 - OD}{a_2} = \frac{b(GOR_0 - GOR)}{a_3} \tag{6}$$

where:

- $a_1$ is an adjustable parameter determined by fitting the ρ data as described above;
- $a_2$ is an adjustable parameter determined by fitting the OD data as described above; and
- $a_3$ is an adjustable parameter determined by fitting the GOR data as described above.

In an FRID plot of OD, ρ, and GOR versus $V^{-\gamma}$, such as in the example depicted in FIG. 6, the fluid properties may be normalized utilizing the determined end points and adjustable parameters. For example, the fitted OD curve 430 may be the third term of Equation (6), or $(OD_0-OD)/a_2$, the fitted ρ curve 432 may be the second term of Equation (6), or $(\rho-\rho_0)/a_1$, and the fitted GOR curve 434 may be may be the fourth term of Equation (6), or $b(GOR_0-GOR)/a_3$. Equation (6) provides that $V^{-\gamma}$ will coincide with a linear (semi-linear for GOR) transformation of each of the three physical properties. Thus, the start of developed flow can be identified as the minimum pumpout volume (or time) 440 at which the fitted OD curve 430, the fitted ρ curve 432, and the fitted GOR curve 434 each substantially coincide with the $V^{-\gamma}$ curve 436. That is, as depicted in the example FRID plot shown in FIG. 6, at the minimum pumpout volume V (or time t) 440 at which the fitted OD curve 430, the fitted ρ curve 432, and the fitted GOR curve 434 each substantially coincide with the $V^{-\gamma}$ curve 436, the stabilized spherical flow of the developed flow regime has commenced, and contamination level thereafter changes linearly with $V^{-\gamma}$. Thus, a transformation of OD, ρ, and GOR theoretically matches $V^{-\gamma}$ during the developed flow regime.

Figure 7:
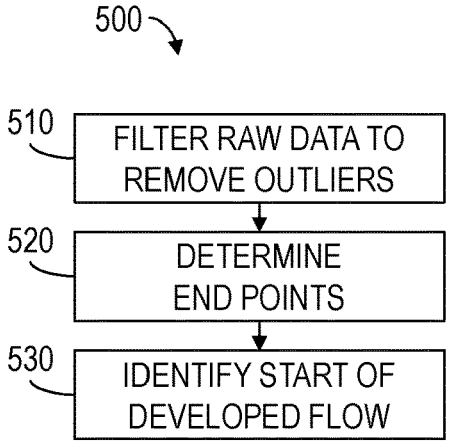
FIG. 7 is a flow-chart diagram of at least a portion of an example implementation of a method according to one or more aspects of the present disclosure.

FIG. 7 is a flow-chart diagram of a method (500) incorporating the aspects described above. The method (500) includes filtering (510) the raw sampling data obtained by the downhole sampling apparatus to remove outliers, such as by utilizing one or more implementations of the method (200) shown in FIG. 2. End points of the fluid properties of the filtered (510) data are then determined (520) via one or more regression techniques to fit the filtered (510) data and obtain the adjustable variables described above, such as β, γ, $a_1$, $a_2$, and $a_3$. Determining (520) the end points may utilize one or more implementations of the method (300) shown in FIG. 3. The start of the developed flow regime may then be determined (530) by plotting the fitted OD, ρ, and GOR versus $V^{-\gamma}$, as depicted in the example FRID plot shown in FIG. 6, and identifying the minimum pumpout volume/time at which the fitted OD, ρ, and GOR substantially coincide with $V^{-\gamma}$. By utilizing the robust regression techniques described above, the fitting of the measured and/or apparent fluid properties will not be adversely affected by the earlier sampling data (such as the data obtained prior to the start of the developing flow regime) or the outlying data obtained during late time pumping (such as outliers in the data obtained during the developing and developed flow regimes). Accordingly, the fittings can be utilized to accurately identify the start of the developed flow regime by crosschecking between each of the fittings.

Figure 8:
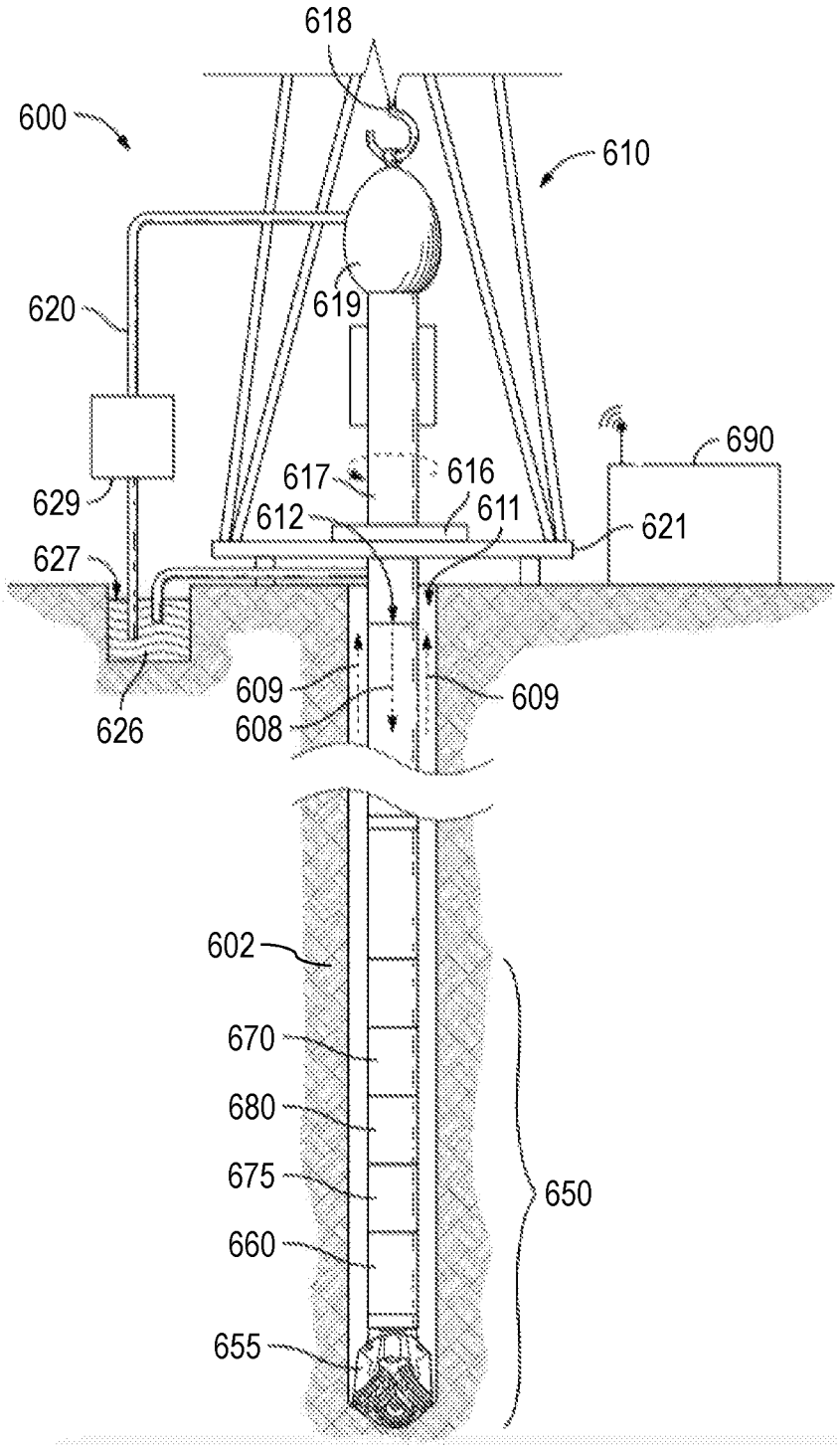
FIG. 8 is a schematic view of at least a portion of an example implementation of apparatus according to one or more aspects of the present disclosure.

FIG. 8 is a schematic view of an example wellsite system 600 in which one or more aspects of OCM disclosed herein may be employed. The wellsite system 600 may be onshore or offshore. In the example system shown in FIG. 8, a borehole 611 is formed in one or more subterranean formations 602 by rotary drilling. However, other example systems within the scope of the present disclosure may also or instead utilize directional drilling.

As shown in FIG. 8, a drillstring 612 suspended within the borehole 611 comprises a bottom hole assembly (BHA) 650 that includes or is coupled with a drill bit 655 at its lower end. The surface system includes a platform and derrick assembly 610 positioned over the borehole 611. The assembly 610 may comprise a rotary table 616, a kelly 617, a hook 618 and a rotary swivel 619. The drill string 612 may be suspended from a lifting gear (not shown) via the hook 618, with the lifting gear being coupled to a mast (not shown) rising above the surface. An example lifting gear includes a crown block whose axis is affixed to the top of the mast, a vertically traveling block to which the hook 618 is attached, and a cable passing through the crown block and the vertically traveling block. In such an example, one end of the cable is affixed to an anchor point, whereas the other end is affixed to a winch to raise and lower the hook 618 and the drillstring 612 coupled thereto. The drillstring 612 comprises one or more types of drill pipes threadedly attached one to another, perhaps including wired drilled pipe.

The drillstring 612 may be raised and lowered by turning the lifting gear with the winch, which may sometimes include temporarily unhooking the drillstring 612 from the lifting gear. In such scenarios, the drillstring 612 may be supported by blocking it with wedges (known as "slips") in a conical recess of the rotary table 616, which is mounted on a platform 621 through which the drillstring 612 passes.

The drillstring 612 may be rotated by the rotary table 616, which engages the kelly 617 at the upper end of the drillstring 612. The drillstring 612 is suspended from the hook 618 and extends through the kelly 617 and the rotary swivel 619 in a manner permitting rotation of the drillstring 612 relative to the hook 618. Other example wellsite systems within the scope of the present disclosure may utilize a top drive system to suspend and rotate the drillstring 612, whether in addition to or instead of the illustrated rotary table system.

The surface system may further include drilling fluid or mud 626 stored in a pit or other container 627 formed at the wellsite. As described above, the drilling fluid 626 may be OBM. A pump 629 delivers the drilling fluid 626 to the interior of the drillstring 612 via a hose or other conduit 620 coupled to a port in the swivel 619, causing the drilling fluid to flow downward through the drillstring 612, as indicated in FIG. 8 by the directional arrow 608. The drilling fluid exits the drillstring 612 via ports in the drill bit 655, and then circulates upward through the annulus region between the outside of the drillstring 612 and the wall of the borehole 611, as indicated in FIG. 8 by the directional arrows 609. In this manner, the drilling fluid 626 lubricates the drill bit 655 and carries formation cuttings up to the surface as it is returned to the container 627 for recirculation.

The BHA 650 may comprise one or more specially made drill collars near the drill bit 655. Each such drill collar may comprise one or more logging devices, thereby permitting measurement of downhole drilling conditions and/or various characteristic properties of the formation 602 intersected by the borehole 611. For example, the BHA 650 may comprise a logging-while-drilling (LWD) module 670, a measurement-while-drilling (MWD) module 680, a rotary-steerable system and motor 660, and perhaps the drill bit 655. Of course, other BHA components, modules, and/or tools are also within the scope of the present disclosure, e.g., as represented in FIG. 8 by reference number 675. References herein to a module at the position of 270 may mean a module at the position of 270A as well.

The LWD module 670 may comprise capabilities for measuring, processing, and storing information pertaining to the formation 602, including for obtaining a sample stream of fluid from the formation 602 and performing fluid analysis on the sample stream as described above. The MWD module 680 may comprise one or more devices for measuring characteristics of the drillstring 612 and/or drill bit 655, such as for measuring weight-on-bit, torque, vibration, shock, stick slip, direction, and/or inclination, among other examples within the scope of the present disclosure. The MWD module 680 may further comprise an apparatus (not shown) for generating electrical power to be utilized by the downhole system. This may include a mud turbine generator powered by the flow of the drilling fluid 626. However, other power and/or battery systems may also or instead be employed.

The wellsite system 600 also comprises a logging and control unit and/or other surface equipment 690 communicably coupled to the LWD and MWD modules 670, 675, and 680. One or more of the LWD and MWD modules 670, 675, and 680 comprise a downhole sampling apparatus operable to obtain downhole a sample of fluid from the subterranean formation and perform DFA to measure or determine various fluid properties of the obtained fluid sample. Such DFA may be utilized for OCM according to one or more aspects described above. The resulting data may then be reported to the surface equipment 690.

The operational elements of the BHA 650 may be controlled by one or more electrical control systems within the BHA 650 and/or the surface equipment 690. For example, such control system(s) may include processor capability for characterization of formation fluids in one or more components of the BHA 650 according to one or more aspects of the present disclosure. Methods within the scope of the present disclosure may be embodied in one or more computer programs that run in one or more processors located, for example, in one or more components of the BHA 650 and/or the surface equipment 690. Such programs may utilize data received from one or more components of the BHA 650, for example, via mud-pulse telemetry and/or other telemetry means, and may be operable to transmit control signals to operative elements of the BHA 650. The programs may be stored on a suitable computer-usable storage medium associated with one or more processors of the BHA 650 and/or surface equipment 690, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a telemetry link, among other examples.

Figure 9:
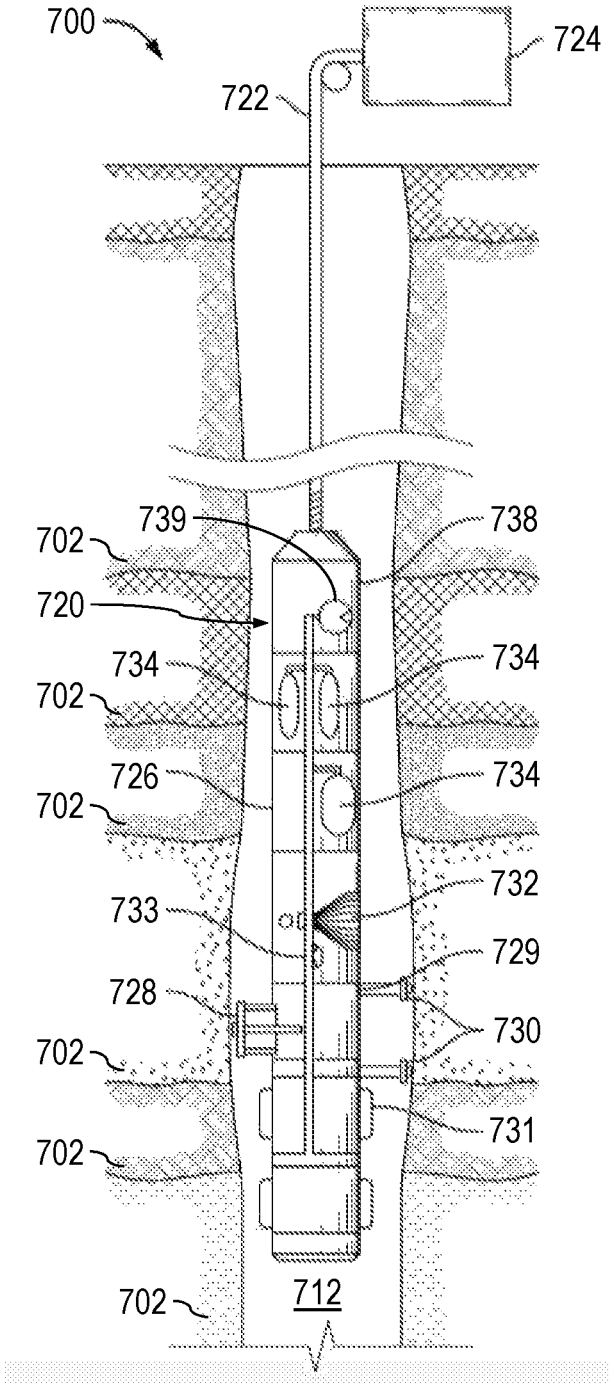
FIG. 9 is a schematic view of at least a portion of an example implementation of apparatus according to one or more aspects of the present disclosure.

FIG. 9 is a schematic view of another example operating environment of the present disclosure wherein a downhole tool 720 is suspended at the end of a wireline 722 at a wellsite having a borehole 712. The downhole tool 720 and wireline 722 are structured and arranged with respect to a service vehicle (not shown) at the wellsite. As with the system 600 shown in FIG. 8, the example system 700 of FIG. 9 may be utilized for downhole sampling and analysis of formation fluids. The system 700 includes the downhole tool 720, which may be used for testing one or more subterranean formations 702 and analyzing the fluids obtained from the formation 702. The system 700 also includes associated telemetry and control devices and electronics (not shown), as well as control, communication, and/or other surface equipment 724. The downhole tool 720 is suspended in the borehole 712 from the lower end of the wireline 722, which may be a multi-conductor logging cable spooled on a winch (not shown). The wireline 722 is electrically coupled to the surface equipment 724, which may have one or more aspects in common with the surface equipment 690 shown in FIG. 8.

The downhole tool 720 comprises an elongated body 726 encasing a variety of electronic components and modules schematically represented in FIG. 9. For example, a selectively extendible fluid admitting assembly 728 and one or more selectively extendible anchoring members 730 are respectively arranged on opposite sides of the elongated body 726. The fluid admitting assembly 728 is operable to selectively seal off or isolate selected portions of the borehole wall 712 such that fluid communication with the adjacent formation 702 may be established. A packer module 731 may also be utilized to establish fluid communication with the adjacent formation 702.

One or more fluid sampling and analysis modules 732 are provided in the tool body 726. Fluids obtained from the formation 702 and/or borehole 712 flow through a flowline 733 of the fluid analysis module or modules 732, and then may be discharged through a port 739 of a pumpout module 738. Alternatively, formation fluids in the flowline 733 may be directed to one or more sample chambers 734 for receiving and retaining the fluids obtained from the formation 702 for transportation to the surface.

The fluid sampling means 729, 731, the fluid analysis modules 732, the flow path (including through the flowline 733, the port 739, and the sample chambers 734), and/or other operational elements of the downhole tool 720 may be controlled by one or more electrical control systems within the downhole tool 720 and/or the surface equipment 724. For example, such control system(s) may include processor capability for characterization of formation fluids in the downhole tool 720 according to one or more aspects of the present disclosure. Methods within the scope of the present disclosure may be embodied in one or more computer programs that run in a processor located, for example, in the downhole tool 720 and/or the surface equipment 724. Such programs may utilize data received from, for example, the fluid sampling and analysis module 732, via the wireline cable 722, and to transmit control signals to operative elements of the downhole tool 720. The programs may be stored on a suitable computer-usable storage medium associated with the one or more processors of the downhole tool 720 and/or surface equipment 724, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a switched telecommunication link, among others.

FIGS. 8 and 9 illustrate examples of environments in which one or more aspects of the present disclosure may be implemented. For example, in addition to the drilling environment of FIG. 8 and the wireline environment of FIG. 9, one or more aspects of the present disclosure may be applicable or readily adaptable for implementation in other environments utilizing other means of conveyance within the borehole, including coiled tubing, TLC, slickline, and others.

Figure 10:
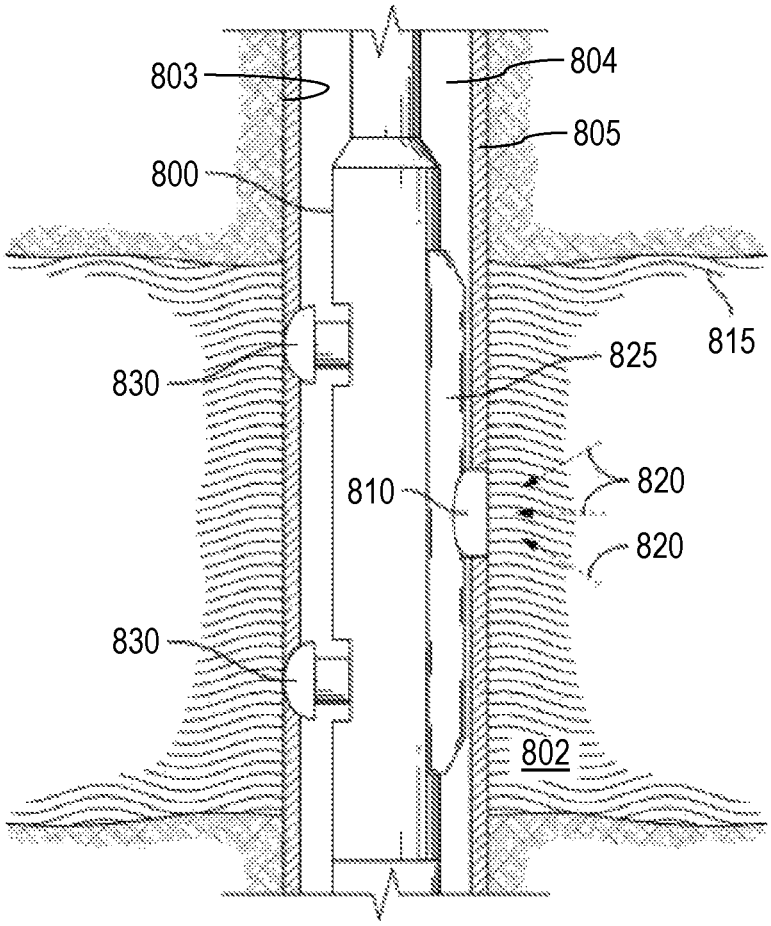
FIG. 10 is a schematic view of at least a portion of an example implementation of apparatus according to one or more aspects of the present disclosure.

An example downhole sampling apparatus 800 that may be utilized in the example systems 600 and 700 of FIGS. 8 and 9, respectively, such as to obtain a sample of fluid from a subterranean formation 802 and perform DFA for OCM of the obtained fluid sample, is schematically shown in FIG. 10. The downhole sampling apparatus 800 is provided with a probe 810 for establishing fluid communication with the formation 802 and drawing formation fluid 815 into the tool, as indicated in FIG. 10 by arrows 820. The probe 810 may be positioned in a stabilizer blade 825 of the tool 800, and may extend therefrom to engage a wall 803 of a borehole 804, which may have a mudcake layer 806 thereon. The stabilizer blade 825 may be or comprise one or more blades that are in contact with the borehole wall 803 and/or mudcake layer 805. The downhole sampling apparatus 800 may comprise backup pistons 830 operable to press the downhole sampling apparatus 800 and, thus, the probe 810 into contact with the borehole wall 803. Fluid drawn into the downhole sampling apparatus 800 via the probe 810 may be measured to determine various fluid properties described above, for example. The downhole sampling apparatus 800 may also comprise chambers and/or other devices for collecting fluid samples for retrieval at the surface.

Figure 11:
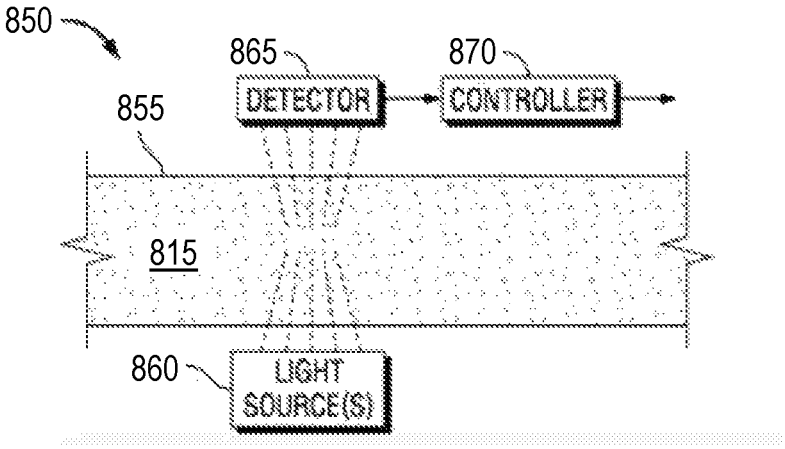
FIG. 11 is a schematic view of at least a portion of an example implementation of apparatus according to one or more aspects of the present disclosure.

An example downhole fluid analyzer 850 that may be used to implement DFA in the example downhole sampling apparatus 800 shown in FIG. 10 is schematically shown in FIG. 11. The downhole fluid analyzer 850 may be part of or otherwise work in conjunction with a downhole tool operable to obtain a sample of fluid 815 from the formation 802, such as the downhole tools/modules shown in FIGS. 8-10. For example, a flowline 855 of the downhole sampling apparatus 800 may extend past an optical spectrometer having one or more light sources 860 and a detector 865. The detector 865 senses light that has transmitted through the formation fluid 815 in the flowline 855, resulting in optical spectra that may be utilized according to one or more aspects of the present disclosure. For example, a controller 870 associated with the downhole fluid analyzer 850 and/or the downhole sampling apparatus 800 may utilize measured optical spectra to perform OCM of the formation fluid 815 in the flowline 855 according to one or more aspects of DFA and/or OCM introduced herein. The resulting information may then be reported via telemetry to surface equipment, such as the surface equipment 690 shown in FIG. 8 and/or the surface equipment 724 shown in FIG. 9. The downhole fluid analyzer 850 may perform the bulk of its processing downhole and report just a relatively small amount of measurement data up to the surface. Thus, the downhole fluid analyzer 850 may provide high-speed (e.g., real-time) DFA measurements using a relatively low bandwidth telemetry communication link. As such, the telemetry communication link may be implemented by most types of communication links, unlike conventional DFA techniques that utilize high-speed communication links to transmit high-bandwidth signals to the surface.

Figure 12:
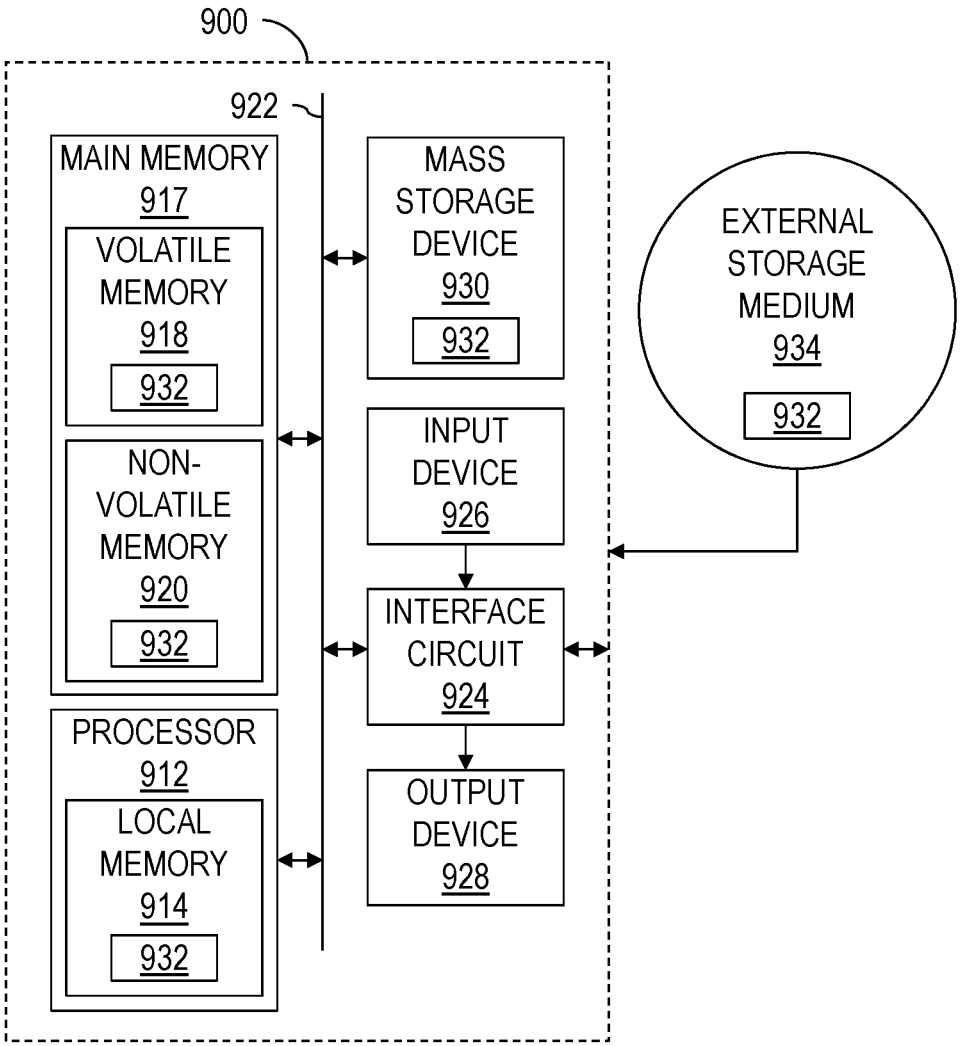
FIG. 12 is a schematic view of at least a portion of an example implementation of apparatus according to one or more aspects of the present disclosure.

FIG. 12 is a schematic view of at least a portion of apparatus according to one or more aspects of the present disclosure. The apparatus is or comprises a processing system 900 that may execute example machine-readable instructions to implement at least a portion of one or more of the methods and/or processes described herein, and/or to implement a portion of one or more of the example downhole tools described herein. The processing system 900 may be or comprise, for example, one or more processors, controllers, special-purpose computing devices, servers, personal computers, personal digital assistant ("PDA") devices, smartphones, internet appliances, and/or other types of computing devices. Moreover, while it is possible that the entirety of the processing system 900 shown in FIG. 12 is implemented within downhole apparatus, such as the LWD and/or MWD modules 270, 275, and/or 280 shown in FIG. 8, the fluid sampling and analysis module 732 shown in FIG. 9, the controller 870 shown in FIG. 11, other components shown in one or more of FIGS. 8-11, and/or other downhole apparatus, it is also contemplated that one or more components or functions of the processing system 900 may be implemented in wellsite surface equipment, perhaps including the surface equipment 690 shown in FIG. 8, the surface equipment 724 shown in FIG. 9, and/or other surface equipment.

The processing system 900 may comprise a processor 912 such as, for example, a general-purpose programmable processor. The processor 912 may comprise a local memory 914, and may execute coded instructions 932 present in the local memory 914 and/or another memory device. The processor 912 may execute, among other things, machine-readable instructions or programs to implement the methods and/or processes described herein. The programs stored in the local memory 914 may include program instructions or computer program code that, when executed by an associated processor, permit surface equipment and/or downhole controller and/or control system to perform tasks as described herein. The processor 912 may be, comprise, or be implemented by one or more processors of various types suitable to the local application environment, and may include one or more of general-purpose computers, special-purpose computers, microprocessors, digital signal processors ("DSPs"), field-programmable gate arrays ("FPGAs"), application-specific integrated circuits ("ASICs"), and processors based on a multi-core processor architecture, as non-limiting examples. Of course, other processors from other families are also appropriate.

The processor 912 may be in communication with a main memory 917, such as may include a volatile memory 918 and a non-volatile memory 920, perhaps via a bus 922 and/or other communication means. The volatile memory 918 may be, comprise, or be implemented by random access memory (RAM), static random access memory (SRAM), synchronous dynamic random access memory (SDRAM), dynamic random access memory (DRAM), RAMBUS dynamic random access memory (RDRAM) and/or other types of random access memory devices. The non-volatile memory 920 may be, comprise, or be implemented by read-only memory, flash memory and/or other types of memory devices. One or more memory controllers (not shown) may control access to the volatile memory 918 and/or the non-volatile memory 920.

The processing system 900 may also comprise an interface circuit 924. The interface circuit 924 may be, comprise, or be implemented by various types of standard interfaces, such as an Ethernet interface, a universal serial bus (USB), a third generation input/output (3GIO) interface, a wireless interface, and/or a cellular interface, among others. The interface circuit 924 may also comprise a graphics driver card. The interface circuit 924 may also comprise a communication device such as a modem or network interface card to facilitate exchange of data with external computing devices via a network (e.g., Ethernet connection, digital subscriber line ("DSL"), telephone line, coaxial cable, cellular telephone system, satellite, etc.).

One or more input devices 926 may be connected to the interface circuit 924. The input device(s) 926 may permit a user to enter data and commands into the processor 912. The input device(s) 926 may be, comprise, or be implemented by, for example, a keyboard, a mouse, a touchscreen, a track-pad, a trackball, an isopoint, and/or a voice recognition system, among others.

One or more output devices 928 may also be connected to the interface circuit 924. The output devices 928 may be, comprise, or be implemented by, for example, display devices (e.g., a liquid crystal display or cathode ray tube display (CRT), among others), printers, and/or speakers, among others.

The processing system 900 may also comprise one or more mass storage devices 930 for storing machine-readable instructions and data. Examples of such mass storage devices 930 include floppy disk drives, hard drive disks, compact disk (CD) drives, and digital versatile disk (DVD) drives, among others. The coded instructions 932 may be stored in the mass storage device 930, the volatile memory 918, the non-volatile memory 920, the local memory 914, and/or on a removable storage medium 934, such as a CD or DVD. Thus, the modules and/or other components of the processing system 900 may be implemented in accordance with hardware (embodied in one or more chips including an integrated circuit such as an application specific integrated circuit), or may be implemented as software or firmware for execution by a processor. In particular, in the case of firmware or software, the embodiment can be provided as a computer program product including a computer readable medium or storage structure embodying computer program code (i.e., software or firmware) thereon for execution by the processor.

In view of the entirety of the present disclosure, including the figures and the claims, a person having ordinary skill in the art should readily recognize that the present disclosure introduces a method comprising obtaining in-situ, real-time data associated with a sample stream obtained by a downhole sampling apparatus disposed in a borehole that extends into a subterranean formation, wherein the obtained data includes a plurality of fluid properties of the sample stream, and wherein the sample stream comprises native formation fluid from the subterranean formation and filtrate contamination resulting from formation of the borehole in the subterranean formation. The method also includes filtering the obtained data to remove outliers from the obtained data, fitting the filtered data to each of a plurality of models that each characterize a corresponding one of the fluid properties as a function of a pumpout volume (V) or time (t) of the sample stream, and identifying a start of a developed flow regime of the native formation fluid within the subterranean formation surrounding the borehole, wherein identifying the start of the developed flow regime is based on the fitted data.

The filtered data may include a number n of data points corresponding to each model, and fitting the filtered data to each model may comprise: (i) with respect to each model, performing a plurality of iterations that each comprise: (a) adjusting a threshold fraction and/or a fit start/end of the model; (b) randomly selecting a sample of m data points from the n data points corresponding to the model; (c) fitting the model to the m data points utilizing the adjusted threshold fraction and/or fit start/end; (d) determining an error function for each of the m data points based on the fitting; and (e) selecting ones of the m data points that are inliers supporting the model for the current iteration based on the error function determined for each of the m data points; (ii) determining an optimal threshold fraction and/or fit start/end based on which of the iterations has the highest percentage of inliers among the m data points of that iteration; and (iii) linearly fitting the inliers selected during the iteration corresponding to the optimal threshold fraction and/or fit start/end.

Identifying the start of the developed flow regime based on the fitted data may comprise: (i) generating a flow regime identification (FRID) plot comprising: the fitted data corresponding to each of the fluid properties, relative to V or t; and an exponential factor of V or t, relative to V or t; and (ii) identifying from the FRID plot the minimum V or t at which the fitted data for each of the fluid properties substantially coincide with the exponential factor of V or t, wherein the start of the developed flow regime is the identified minimum V or t. The exponential factor of V or t may be $V^{-y}$ or $t^{-y}$, where y is an adjustable parameter that may be obtained based on the fitted data.

The fluid properties may comprise apparent optical density (OD) of the sample stream, apparent mass density (ρ) of the sample stream, and apparent gas-oil ratio (GOR) of the sample stream, each determined by the downhole sampling apparatus. Thus, obtaining the in-situ, real-time data may comprise obtaining OD data, ρ data, and GOR data, filtering the obtained data may comprise removing outliers from the OD data, ρ data, and GOR data, and fitting the filtered data may comprise fitting the OD data, the ρ data, and the GOR data to corresponding models that each characterize a corresponding one of OD, ρ, and GOR as a function of V or t. Similarly, generating the FRID plot may comprise plotting each of the fitted OD data, the fitted ρ data, and the fitted GOR data relative to V or t, and identifying the start of the developed flow regime may comprise identifying, from the FRID plot, the minimum V or t at which the plotted OD, ρ, and GOR data each substantially coincide with the exponential factor of V or t, wherein the start of the developed flow regime is the identified minimum V or t.

Filtering the obtained data to remove outliers may comprise truncating the obtained data based on a range of one of the fluid properties. For example, one of the fluid properties may apparent optical density (OD) of the sample stream, and truncating the obtained data may comprise truncating the obtained data to data points in which the OD ranges between about −1.0 and about 5.0. One of the fluid properties may be apparent mass density (ρ) of the sample stream, and truncating the obtained data may comprise truncating the obtained data to data points in which the ρ is less than about 1.5 g/cm$^3$. One of the fluid properties may be apparent gas-oil-ratio (GOR) of the sample stream, and truncating the obtained data may comprise truncating the obtained data to data points in which the GOR is less than about 1,000,000 scf/bbl. Filtering the obtained data may further comprise truncating the obtained data based on a range of V or t. For example, truncating the obtained data based on the range of V or t may comprise truncating the obtained data to those data points in which the V or t is greater than the V or t at which native formation fluid is first detected in the sample stream. Filtering the obtained data may further comprise downsampling the obtained data. Filtering the obtained data may further comprise filtering the obtained data utilizing a median filter, a Winsorized mean filter, or a Hampel filter.

The fluid properties may comprise apparent optical density (OD) of the sample stream, apparent mass density (ρ) of the sample stream, and apparent gas-oil-ratio (GOR) of the sample stream, and filtering the obtained data may comprise: (i) truncating the obtained data to data points in which the OD is between about zero and about 3.0, the ρ is between about 0.1 g/cm$^3$ and about 1.2 g/cm$^3$, the GOR is less than about 50,000 scf/bbl, and the V or t is greater than the V or t at which native formation fluid is first detected in the sample stream; (ii) downsampling the truncated data; and (iii) filtering the downsampled data utilizing a Hampel filter.

In a similar implementation, the fluid properties may comprise apparent optical density (OD) of the sample stream, apparent mass density (ρ) of the sample stream, and apparent gas-oil-ratio (GOR) of the sample stream, and filtering the obtained data may comprise: (i) truncating the obtained data to data points in which the OD is between about zero and about 1.5, the ρ is between about 0.6 g/cm$^3$ and about 0.9 g/cm$^3$, the GOR is less than about 1,000 scf/bbl, and the V or t is greater than the V or t at which native formation fluid is first detected in the sample stream; and (ii) filtering the truncated data utilizing a median filter or a Winsorized mean filter.

The present disclosure also introduces a method comprising obtaining in-situ, real-time data associated with a sample stream obtained by a downhole sampling apparatus disposed in a borehole that extends into a subterranean formation, wherein the downhole sampling apparatus is operable to obtain apparent optical density (OD), apparent mass density (ρ), and apparent gas-oil ratio (GOR) of the sample stream such that the obtained data comprises OD data, ρ data, and GOR data, and wherein the sample stream comprises native formation fluid from the subterranean formation and filtrate contamination resulting from formation of the borehole in the subterranean formation. The method also comprises filtering the obtained data to remove outliers from the OD data, the ρ data, and the GOR data, and fitting the filtered OD, ρ, and GOR data to a corresponding one of a plurality of models that each characterize a corresponding one of OD, ρ, and GOR as a function of a pumpout volume (V) or time (t) of the sample stream, wherein fitting the filtered OD, ρ, and GOR data to the corresponding models includes determining an adjustable parameter y relating the filtered OD, ρ, and GOR data to V or t. The method also comprises identifying a start of a developed flow regime of the native formation fluid within the subterranean formation surrounding the borehole by: (i) generating a flow regime identification (FRID) plot by collectively plotting, relative to V or t: the fitted OD data, the fitted ρ data, the fitted GOR data, and one of $V^{-y}$ or $t^{-y}$; and (ii) identifying from the FRID plot the minimum V or t at which the plotted OD, ρ, and GOR data each substantially coincide with the one of $V^{-y}$ or $t^{-y}$, wherein the start of the developed flow regime is the identified minimum V or t.

Filtering the obtained data may comprise: (i) truncating the obtained data to data points in which the OD is less than a first predetermined threshold, the ρ is within a predetermined range, the GOR is greater than a second predetermined threshold, and the V or t is greater than the V or t at which native formation fluid is first detected in the sample stream; (ii) downsampling the truncated data; and (iii) filtering the downsampled data utilizing a Hampel filter. Filtering the obtained data may instead comprise: (i) truncating the obtained data to data points in which the OD is less than a first predetermined threshold, the ρ is within a predetermined range, the GOR is greater than a second predetermined threshold, and the V or t is greater than the V or t at which native formation fluid is first detected in the sample stream; and (ii) filtering the truncated data utilizing a median filter or a Winsorized mean filter.

The present disclosure also introduces an apparatus comprising: a downhole sampling apparatus operable within a borehole extending from a wellsite surface into a subterranean formation; and surface equipment disposed at the wellsite surface and in communication with the downhole sampling apparatus, wherein the downhole sampling apparatus and the surface equipment are collectively operable to: (i) obtain in-situ, real-time data associated with a sample stream obtained by the downhole sampling apparatus disposed within the borehole, wherein the obtained data includes a plurality of fluid properties of the sample stream, and wherein the sample stream comprises native formation fluid from the subterranean formation and filtrate contamination resulting from formation of the borehole in the subterranean formation; (ii) filter the obtained data to remove outliers from the obtained data; (iii) fit the filtered data to each of a plurality of models each characterizing a corresponding one of the fluid properties as a function of a pumpout volume (V) or time (t) of the sample stream; and (iv) identify, based on the fitted data, a start of a developed flow regime of the native formation fluid within the subterranean formation surrounding the borehole.

The fluid properties may comprise apparent optical density (OD) of the sample stream, apparent mass density (ρ) of the sample stream, and apparent gas-oil-ratio (GOR) of the sample stream. In such implementations, among others within the scope of the present disclosure, the downhole sampling apparatus and the surface equipment may be collectively operable to filter the obtained data by: (i) truncating the obtained data to data points in which the OD is less than a first predetermined threshold, the ρ is within a predetermined range, the GOR is greater than a second predetermined threshold, and the V or t is greater than the V or t at which native formation fluid is first detected in the sample stream; (ii) downsampling the truncated data; and (iii) filtering the downsampled data.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A method comprising:

obtaining in-situ, real-time data associated with a sample stream obtained by a downhole sampling apparatus disposed in a borehole that extends into a subterranean formation, wherein the downhole sampling apparatus is in electrical communication with surface equipment disposed at a wellsite surface from which the borehole extends, wherein the obtained data includes a plurality of fluid properties of the sample stream, and wherein the sample stream comprises:

native formation fluid from the subterranean formation; and filtrate contamination resulting from formation of the borehole in the subterranean formation;

via operation of a processor at at least one of the downhole sampling apparatus and the surface equipment:

using the processor to statistically filter the obtained data to remove outliers from the obtained data;

fitting the filtered data to each of a plurality of models each characterizing a corresponding one of the fluid properties as a function of a pumpout volume (V) or time (t) of the sample stream; and identifying a start of a developed flow regime of the native formation fluid within the subterranean formation surrounding the borehole, wherein identifying the start of the developed flow regime is based on the fitted data; and operating the downhole sampling apparatus based on the identified start of the developed flow regime of the native formation fluid.

2. The method of claim 1 wherein identifying the start of the developed flow regime based on the fitted data comprises:

generating a flow regime identification (FRID) plot comprising:

the fitted data corresponding to each of the fluid properties, relative to V or t; and an exponential factor of V or t, relative to V or t; and identifying from the FRID plot the minimum V or t at which the fitted data for each of the fluid properties substantially coincide with the exponential factor of V or t, wherein the start of the developed flow regime is the identified minimum V or t.

3. The method of claim 2 wherein the exponential factor of V or t is $V^{-y}$ or $t^{-y}$, and wherein y is an adjustable parameter obtained based on the fitted data.

4. The method of claim 2 wherein:

the fluid properties comprise apparent optical density (OD) of the sample stream, apparent mass density (ρ) of the sample stream, and apparent gas-oil ratio (GOR) of the sample stream, each determined by the downhole sampling apparatus;

obtaining the in-situ, real-time data comprises obtaining OD data, ρ data, and GOR data;

filtering the obtained data comprises removing outliers from the OD data, the ρ data, and the GOR data;

fitting the filtered data comprises fitting the OD data, the ρ data, and the GOR data to corresponding models each characterizing a corresponding one of OD, ρ, and GOR as a function of V or t;

generating the FRID plot comprises plotting each of the fitted OD data, the fitted ρ data, and the fitted GOR data relative to V or t; and identifying the start of the developed flow regime comprises identifying, from the FRID plot, the minimum V or t at which the plotted OD, ρ, and GOR data each substantially coincide with the exponential factor of V or t, wherein the start of the developed flow regime is the identified minimum V or t.

5. The method of claim 1 wherein filtering the obtained data to remove outliers comprises truncating the obtained data based on a range of one of the fluid properties.

6. The method of claim 5 wherein one of the fluid properties is apparent optical density (OD) of the sample stream, and wherein truncating the obtained data comprises truncating the obtained data to data points in which the OD is between about −1.0 and about 5.0.

7. The method of claim 5 wherein one of the fluid properties is apparent mass density (ρ) of the sample stream, and wherein truncating the obtained data comprises truncating the obtained data to data points in which the ρ is less than about 1.5 g/cm$^3$.

8. The method of claim 5 wherein one of the fluid properties is apparent gas-oil-ratio (GOR) of the sample stream, and wherein truncating the obtained data comprises truncating the obtained data to data points in which the GOR is less than about 1,000,000 scf/bbl.

9. The method of claim 5 wherein filtering the obtained data further comprises truncating the obtained data based on a range of V or t.

10. The method of claim 9 wherein truncating the obtained data based on the range of V or t comprises truncating the obtained data to those data points in which the V or t is greater than the V or t at which native formation fluid is first detected in the sample stream.

11. The method of claim 5 wherein filtering the obtained data further comprises downsampling the obtained data.

12. The method of claim 5 wherein filtering the obtained data further comprises filtering the obtained data utilizing a median filter, a Winsorized mean filter, or a Hampel filter.

13. The method of claim 1 wherein the fluid properties comprise apparent optical density (OD) of the sample stream, apparent mass density (ρ) of the sample stream, and apparent gas-oil-ratio (GOR) of the sample stream, and wherein filtering the obtained data comprises:

truncating the obtained data to data points in which:
- the OD is between zero and about 3.0;
- the ρ is between about 0.1 g/cm$^3$ and about 1.2 g/cm$^3$;
- the GOR is less than about 50,000 scf/bbl; and
- the V or t is greater than the V or t at which native formation fluid is first detected in the sample stream;

downsampling the truncated data; and filtering the downsampled data utilizing a Hampel filter.

14. The method of claim 1 wherein the fluid properties comprise apparent optical density (OD) of the sample stream, apparent mass density (ρ) of the sample stream, and apparent gas-oil-ratio (GOR) of the sample stream, and wherein filtering the obtained data comprises:

truncating the obtained data to data points in which:
- the OD is between about zero and about 1.5;
- the ρ is between about 0.6 g/cm$^3$ and about 0.9 g/cm$^3$;
- the GOR is less than about 1,000 scf/bbl; and
- the V or t is greater than the V or t at which native formation fluid is first detected in the sample stream; and filtering the truncated data utilizing a median filter or a Winsorized mean filter.

15. The method of claim 1 wherein the filtered data includes a number n of data points corresponding to each model, and wherein fitting the filtered data to each model comprises:

with respect to each model, performing a plurality of iterations that each comprise:
- adjusting a threshold fraction and/or a fit start/end of the model;
- randomly selecting a sample of m data points from the n data points corresponding to the model;
- fitting the model to the m data points utilizing the adjusted threshold fraction and/or fit start/end;
- determining an error function for each of the m data points based on the fitting; and
- selecting ones of the m data points that are inliers supporting the model for the current iteration based on the error function determined for each of the m data points;

determining an optimal threshold fraction and/or fit start/end based on which of the iterations has the highest percentage of inliers among the m data points of that iteration; and linearly fitting the inliers selected during the iteration corresponding to the optimal threshold fraction and/or fit start/end.

16. A method comprising:

obtaining in-situ, real-time data associated with a sample stream obtained by a downhole sampling apparatus disposed in a borehole that extends into a subterranean formation, wherein the downhole sampling apparatus is in electrical communication with surface equipment disposed at a wellsite surface from which the borehole extends, wherein the downhole sampling apparatus is operable to obtain apparent optical density (OD), apparent mass density (ρ), and apparent gas-oil ratio (GOR) of the sample stream such that the obtained data comprises OD data, ρ data, and GOR data, and wherein the sample stream comprises:
- native formation fluid from the subterranean formation; and
- filtrate contamination resulting from formation of the borehole in the subterranean formation; and via operation of a processor at at least one of the downhole sampling apparatus and the surface equipment:
- using the processor to statistically filter the obtained data to remove outliers from the OD data, the ρ data, and the GOR data;
- fitting the filtered OD, ρ, and GOR data to a corresponding one of a plurality of models each characterizing a corresponding one of OD, ρ, and GOR as a function of a pumpout volume (V) or time (t) of the sample stream, wherein fitting the filtered OD, ρ, and GOR data to the corresponding models includes determining an adjustable parameter y relating the filtered OD, ρ, and GOR data to V or t; and
- identifying a start of a developed flow regime of the native formation fluid within the subterranean formation surrounding the borehole by:
  - generating a flow regime identification (FRID) plot by collectively plotting, relative to V or t:
    - the fitted OD data;
    - the fitted ρ data;
    - the fitted GOR data; and
    - one of $V^{-y}$ or $t^{-y}$; and
- identifying from the FRID plot the minimum V or t at which the plotted OD, ρ, and GOR data each substantially coincide with the one of $V^{-y}$ or $t^{-y}$, wherein the start of the developed flow regime is the identified minimum V or t; and operating the downhole sampling apparatus based on the identified start of the developed flow regime of the native formation fluid.

17. The method of claim 16 wherein filtering the obtained data comprises:

truncating the obtained data to data points in which:
- the OD is less than a first predetermined threshold;
- the ρ is within a predetermined range;
- the GOR is greater than a second predetermined threshold; and
- the V or t is greater than the V or t at which native formation fluid is first detected in the sample stream;

downsampling the truncated data; and filtering the downsampled data utilizing a Hampel filter.

18. The method of claim 16 wherein filtering the obtained data comprises:

truncating the obtained data to data points in which:
- the OD is less than a first predetermined threshold;
- the ρ is within a predetermined range;

the GOR is greater than a second predetermined threshold; and the V or t is greater than the V or t at which native formation fluid is first detected in the sample stream; and filtering the truncated data utilizing a median filter or a Winsorized mean filter.

19. An apparatus comprising:

a downhole sampling apparatus operable within a borehole extending from a wellsite surface into a subterranean formation; and surface equipment disposed at the wellsite surface and in communication with the downhole sampling apparatus, wherein the downhole sampling apparatus and the surface equipment are collectively operable to:

obtain in-situ, real-time data associated with a sample stream obtained by the downhole sampling apparatus disposed within the borehole, wherein the obtained data includes a plurality of fluid properties of the sample stream, and wherein the sample stream comprises:

native formation fluid from the subterranean formation; and filtrate contamination resulting from formation of the borehole in the subterranean formation;

using a processor at at least one of the downhole sampling apparatus and the surface equipment, statistically filter the obtained data to remove outliers from the obtained data;

fit the filtered data to each of a plurality of models each characterizing a corresponding one of the fluid properties as a function of a pumpout volume (V) or time (t) of the sample stream;

identify, based on the fitted data, a start of a developed flow regime of the native formation fluid within the subterranean formation surrounding the borehole; and apply the identified start of the developed flow regime of the native formation fluid in an operation of the downhole sampling apparatus.

20. The apparatus of claim 19 wherein the fluid properties comprise apparent optical density (OD) of the sample stream, apparent mass density (ρ) of the sample stream, and apparent gas-oil-ratio (GOR) of the sample stream, and wherein the downhole sampling apparatus and the surface equipment are collectively operable to filter the obtained data by:

truncating the obtained data to data points in which:

the OD is less than a first predetermined threshold;

the ρ is within a predetermined range;

the GOR is greater than a second predetermined threshold; and the V or t is greater than the V or t at which native formation fluid is first detected in the sample stream;

downsampling the truncated data; and filtering the downsampled data.

* * * * *